United States Patent [19]

Rys

[11] 4,079,346

[45] Mar. 14, 1978

[54] MOUNTING PLATE FOR MOLDED CASE CIRCUIT BREAKER

[75] Inventor: Tadeusz J. Rys, Bellefontaine, Ohio

[73] Assignee: I-T-E Imperial Corporation, Spring House, Pa.

[21] Appl. No.: 703,078

[22] Filed: Jul. 6, 1976

[51] Int. Cl.[2] ..... H01H 9/00; H01H 13/02

[52] U.S. Cl. ..... 335/23; 335/6; 335/202

[58] Field of Search ..... 335/6, 21, 23, 38, 170, 335/174, 191, 202

[56] References Cited

U.S. PATENT DOCUMENTS

| | | | |
|---|---|---|---|
| 3,477,044 | 11/1969 | Gryctko | 335/23 |
| 3,774,129 | 11/1973 | Sugiyama | 335/191 |
| 3,970,976 | 7/1976 | Nicol | 335/21 |

*Primary Examiner*—Harold Broome

*Attorney, Agent, or Firm*—Ostrolenk, Faber, Gerb & Soffen

[57] ABSTRACT

A single pole molded case circuit breaker is constructed with an internal metal frame to which the contact operating mechanism is mounted. This frame provides the pivot bearings for main elements of the mechanism as well as having integrally formed stops for certain of these elements.

8 Claims, 22 Drawing Figures

39
117
78
81
38
112
76
46
38
91
89
115
116
86
88
79
87
75
97
46
4a
99
65
64
56
92
93
90
106
94
98
85
95
64
56

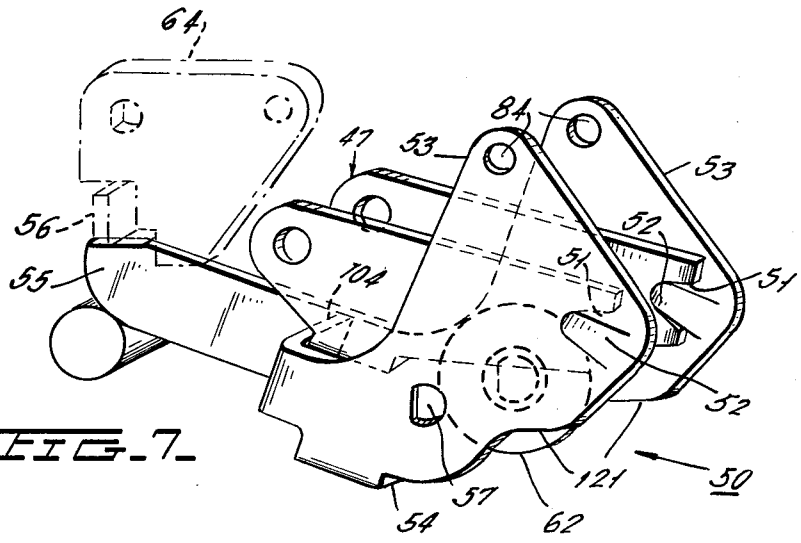
FIG. 7.
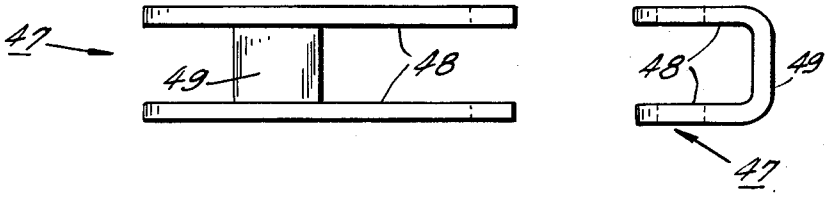
FIG. 12.
FIG. 13.
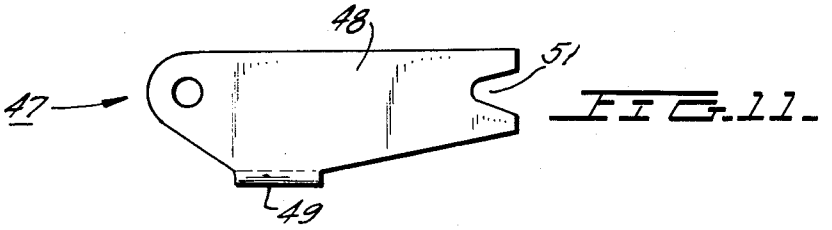
FIG. 11.
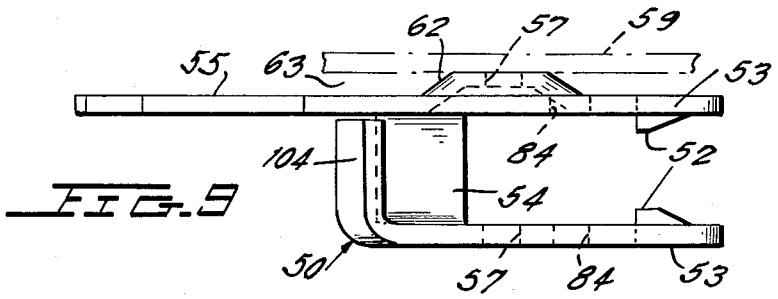
FIG. 9
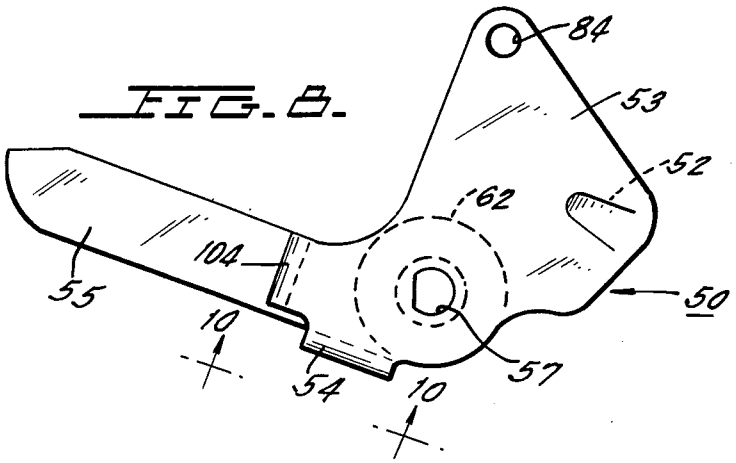
FIG. 8.
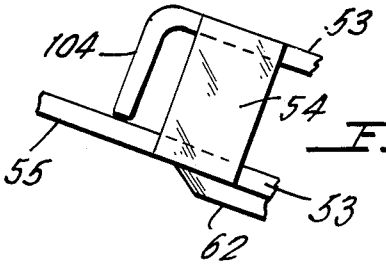
FIG. 10.

MOUNTING PLATE FOR MOLDED CASE CIRCUIT BREAKER

This invention relates to molded case circuit breakers of moderately high current rating and more particularly relates to utilization of a metal frame to pivotally support the elements of the contact operating mechanism.

The F. W. Kussy copending application Ser. No. 642,497 filed Dec. 19, 1975 for Stacked Circuit Breakers Having High Interrupting Capacity, assigned to the assignee of the instant invention, describes the construction of single pole molded case circuit breakers of moderately high current rating, say 150 amps at 600 volts with an interrupting capacity of greater than 10,000 amps. The circuit breaker of the aforesaid copending application Ser. No. 642,497 is of particularly compact construction and utilizes conventional molded case circuit breaker construction techniques in that housing formations are utilized to provide pivot bearings for the contact operating mechanism elements. This type of construction leads to difficulty in obtaining operating repeatability from unit to unit in that the plastic housing is subject to excessive expansion and contraction with accompanying distortion of pivot bearing and locating surfaces.

In order to overcome the aforesaid difficulties of the prior art, the instant invention utilizes a metal frame to provide pivot bearings for certain of the contact mechanism operating elements. In particular, the metal frame provides pivot bearings for the manual operating member, the releasable cradle and trip latch as well as for a trip member which transfers motion from the thermal and magnetic trip member to the trip latch for unlatching thereof. The frame also includes integrally formed stops for the cradle and trip latch as well as notches for locating the frame in the molded housing. Means are also provided for connecting the frame to the line terminal member so that line potential is applied through the frame to the end of the arc chute remote from the stationary contact.

Accordingly, a primary object of the instant invention is to provide a circuit breaker construction in which overall quality and reliability of mechanism operation are improved.

Another object is to provide a construction of this type in which the main operating elements are assembled outside of the circuit breaker housing and the assembly is thereafter readily mounted within the housing.

Still another object is to provide a circuit breaker of this type having a reduced number of elements to accomplish required functions.

A further object is to provide a circuit breaker of this type in which functioning of the mechanism is independent of dimensional fluctuations of the plastic housing.

A still further object is to provide a circuit breaker of this type which achieves improved current interruption.

These objects as well as other objects of this invention shall readily become apparent after reading the following description of the accompanying drawings in which:

FIG. 1 is a side elevation of a circuit breaker pole unit constructed in accordance with teachings of the instant invention, with the near housing half removed so as to reveal the internal elements.

FIG. 2*a* is a fragmentary plan view in the vicinity of line 2*a*, 2*a* of FIG. 1 looking in the direction of arrows 2*a*, 2*a* to illustrate the line terminal number disposed within the housing.

FIG. 2*b* is a plan view through line 2*b*, 2*b* of FIG. 1 looking in the direction of arrows 2*b*, 2*b* to illustrate the position of the contact operating elements in the housing.

FIG. 2*c* is a cross-section taken through line 2*c*, 2*c* of FIG. 1 looking in the direction of arrows 2*c*, 2*c*.

FIG. 3 is a side elevation of the instantaneous trip elements, with the armature being partially sectioned.

FIG. 4*a* is an edge view of the latch member, looking in the direction of arrows 4*a*, 4*a* of FIG. 3.

FIG. 4*b* is an elevation of the wire link connecting the latch and trip members, looking in the direction of arrows 4*b*, 4*b* of FIG. 3.

FIG. 7 is a perspective illustrating the mounting of the toggle to the cradle.

FIG. 8 is a side elevation of the cradle.

FIG. 9 is a plan view of the cradle.

FIG. 10 is a partial bottom view of the cradle looking in the direction of arrows 10, 10 of FIG. 8.

FIG. 11 is a side elevation of the toggle element that abuts the cradle.

FIGS. 12 and 13 are a plan and end view, respectively, of the toggle link of FIG. 11.

Figure 2A:
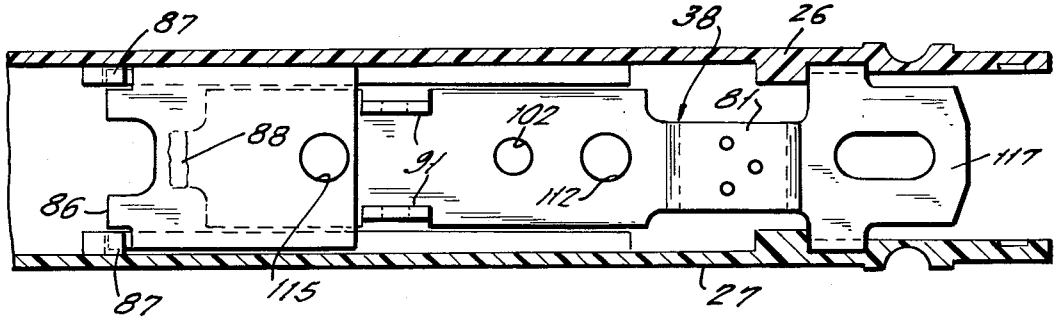
Figure 2B:
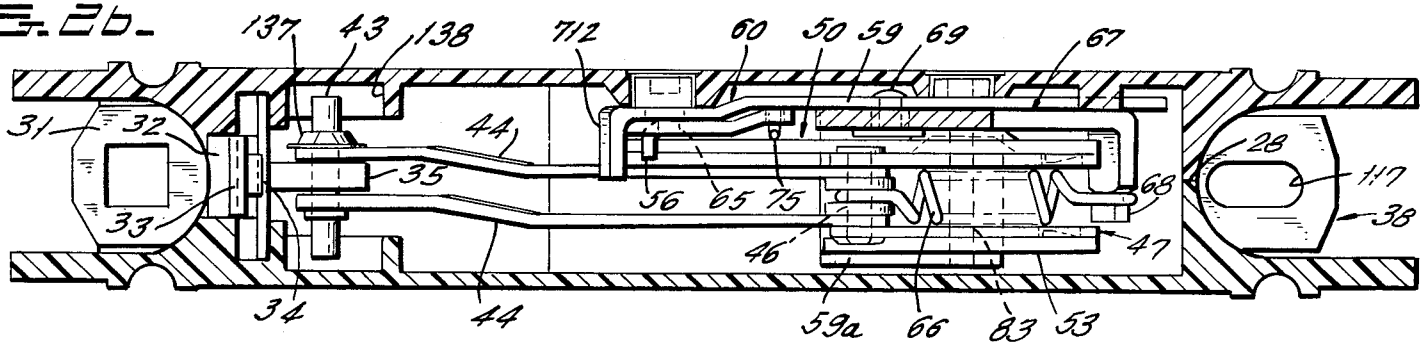

Now referring to the Figures. Circuit breaker pole unit 25 is provided with molded insulating housing consisting of sections 26, 27 which mate at line 28 (FIG. 2*b*) and are secured together by rivets 29. The current carrying path through circuit breaker 25 extends from load terminal 31, to which a wire grip (not shown) may be mounted, stationary contact 33 at the end of load terminal strap 32 remote from load terminal 31, movable contact 34 at one end of movable contact arm 35, through contact arm 35 and braid 36 connected to the other end of arm 35, through bimetal 37 to line terminal member 38 whose right end 39 is positioned for mounting of a wire grip (not shown).

Thin insulating sheet 41 is interposed between movable contact arm 35 and load terminal strap 32 to electrically insulate these elements for a major portion of the length of contact arm 35. However, these elements are so close to one another that current limiting through contact blow-off is achieved by interaction of magnetic fields which accompany current flow in strap 32 and arm 35.

The lower end of contact arm 35 is pivotally mounted on a fixed pivot provided by pin 42 whose ends extend into recesses in both housing portions 26 and 27. Pin 43, located at a point between movable contact 34 and pin 42, connects contact arm 35 to one end of toggle link 44 having its other end connected by pin 46 to the other toggle member 47. Link 44 consists of two identical parallel arms spaced by the thickness of contact arm 35. As seen in FIGS. 7 and 11–13, toggle link 47 is a bifurcated element having parallel sections 48, 48 joined by web 49. Sections 48, 48 are each provided with a V-notch 51 which receives a boss 52 on the inner surface of parallel walls 53, 53 of cradle 50 which are joined by web 54. One wall 53 is provided with a bent over portion 104 that extends to the other wall 53, and the latter is provided with latching tip extension 55 engageable by latching protrusion 56. Portion 104 is engageable with link 47 to act as a kicker for separation of contacts 33, 34 should they tend to weld or otherwise stick closed.

Figures 3, 4A, 4B:
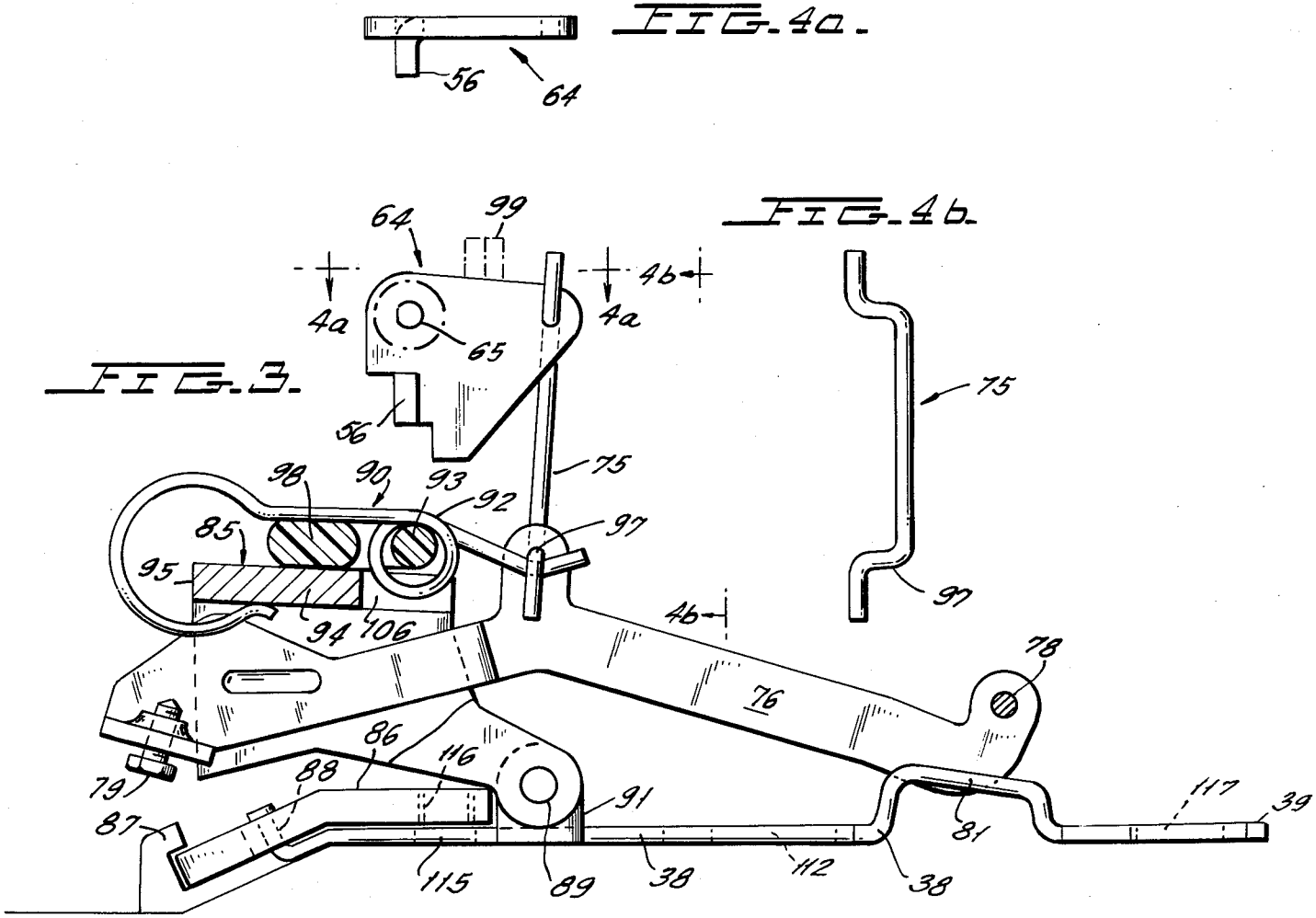

Aligned apertures 57 in walls 53, 53 receive pin 58 which pivotally mounts cradle 50 to formed mounting plate or frame 60 (FIGS. 14–16) at aligned apertures 61*a*, 61*b* thereof. Aperture 61*b* is in main wall 59 and aperture 61*a* is in auxiliary wall 59*a* of plate 60. Web section 59*b* connects walls 59, 59*a* in spaced parallel relationship. Screw 101 (FIG. 1) extends through clearance aperture 102 in terminal member 38 and is received by threaded aperture 103 in web 59*b* to secure mounting plate 60 to member 38. Embossment 62 of cradle 50 provides narrow space 63 between latching tip 55 and frame wall 59. Cantilevered latching protrusion 56 extends perpendicular to the main planar portion of latch member 64 (FIG. 4*a*) and is formed therewith. Member 64 is mounted on plate 60 by cantilevered pivot pin 65 at aperture 66 of plate 60.

Main operating spring 66 (FIG. 2*b*) is a coiled tension member connected at one of its ends to toggle knee pin 46 and at the other of its ends to operating member 67 at projection 68 thereof. Member 67 is mounted to pivot pin 69 that extends through aperture 71 in main wall 59 of mounting member 60. The upper end of operating member 67 extends into a complementary recess in the lower surface of handle member 72. The latter includes extension or handle 73 which projects through housing opening 74 so that handle 73 is engageable for manual operation of circuit breaker 25.

Figure 1:
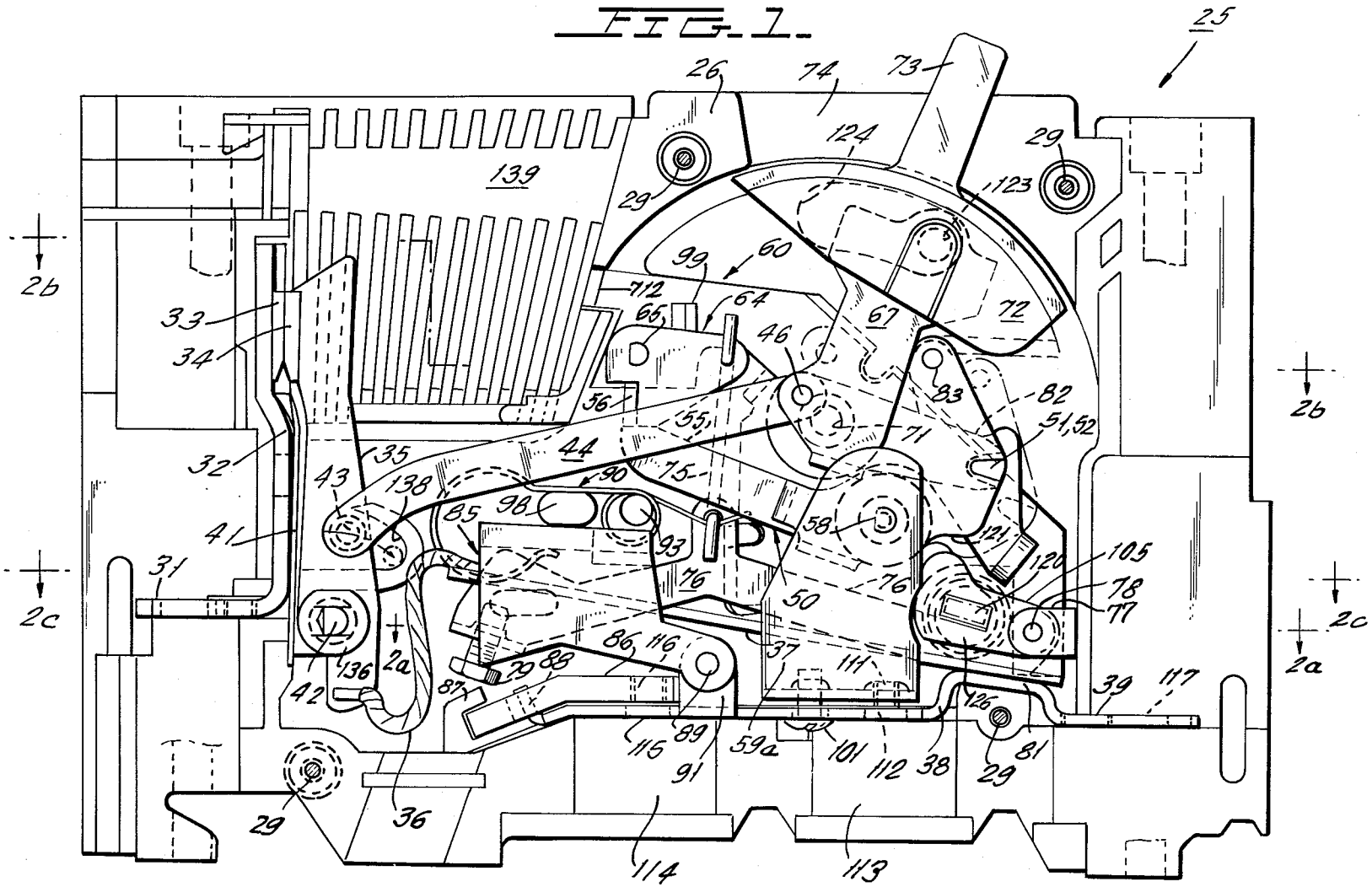
Figure 2C:
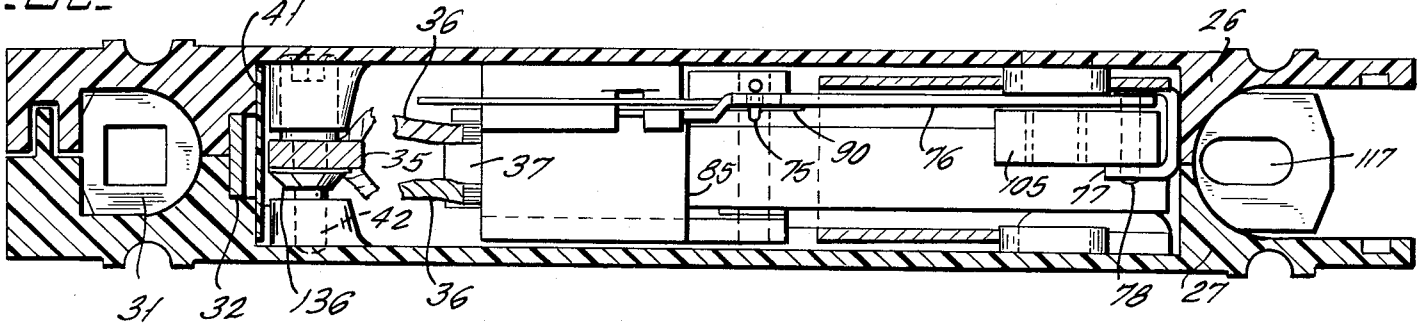

Formed wire link 75 (FIG. 4*b*) connects latch member 64 to trip member 76 at a point intermediate the ends of the latter. Member 76 is pivotally mounted at one of its ends to mounting member ear 77 by pin 78 which also pivotally mounts plastic interpole trip lever 105 (FIG. 2*c*). Lever 105 and member 76 are disposed side-by-side between ear 77 and wall 59. Adjustment screw 79 is threadably mounted to end of trip member 76 remote from pin 78. As seen in FIG. 1, the right end of the bimetal 37 is fixedly secured to inclined offset 81 of line terminal member 38 and the free end of bimetal 37 is aligned with screw 79. Upon heating of bimetal 37 due to abnormal current conditions existing for an extended period of time, the free end of bimetal 37 deflects and engages screw 79 to pivot trip member 76 counterclockwise with respect to FIG. 1. This moves link 75 downward to pivot latch member 64 clockwise whereby latch 56 releases cradle tip 55. Now, under the influence of main operating spring 66 cradle 50 pivots clockwise and moves the right end of toggle 44, 47 below the line of action of spring 66 so that the latter is effective to move toggle link 46 rapidly to the right with respect to FIG. 1 causing contact arm 35 to pivot clockwise and separate movable contact 34 from stationary contact 33.

To reset cradle 50, handle 73 is moved to the left with respect to FIG. 1 with resetting surface 82 of operating member 67 engaging reset pin 83 mounted at apertures 84, 84 (FIG. 7) of cradle 50 to move the latter counterclockwise until latch tip 55 falls below latch 56. To reduce friction between member 67 and pin 83 the latter is loosely mounted in apertures 84, 84 so that there is rolling engagement between pin 83 and member 67. Subsequent movement of handle 73 to the right with respect to FIG. 1 moves the right end of spring 66 downward until its line of action is below the right end of toggle 44, 47 at which point spring 66 moves toggle link 46 downward. This extends toggle 44, 47 thereby moving contact 34 into engagement with contact 33. For manually opening circuit breaker 25 handle 73 is moved to the left with respect to FIG. 1 and in so doing the right end of spring 66 is moved above the right end of toggle 44, 47 so that the line of action of spring 66 is then directed to collapse toggle 44, 47 and separate movable contact 34 from stationary contact 33.

In addition to thermal trip means provided by bimetal 37, circuit breaker 25 also includes magnetic or instantaneous trip means comprising stationary magnetic plate 86 and U-shaped armature 85 (FIGS. 17 and 18) having arms 107, 107 between which bimetal 37 extends. The left edge of plate 86 is captured under housing formation 87 and plate 86 is secured to the upwardly extending tab 88 at the left end of line terminal member 38. Pin 89 pivotally mounts armature 85 to upward extending ears 91, 91 of line terminal member 38. Dual purpose formed wire spring 90 includes central looped portion 92 that receives housing formation 93 and extends into armature clearance notch 106. The left end of spring 90 is curved and reversely bent to engage inner surface 94 of armature 85 at its web portion 95. The right end of spring 90 is interposed between link 75 and trip member 76 to bear against step 97 of link 75. The loading and positioning of spring 90 is such that it biases armature 85 clockwise against housing formation stop 98 and also biases link 75 upward. This biases trip member 75 clockwise about its pivot 78 and biases latch member 64 counterclockwise toward its latching position in engagement with mounting plate stop formation 99.

Mounting plate 60 is constructed of steel sheet and is utilized in order to obtain improved dimensional stability between the operating elements of circuit breaker 25. Thus, mounting plate 60 includes aperture 66 which provides a pivot bearing for trip latch 64; aperture 71 which provides a pivot bearing for operating member 67; aligned apertures 61*a*, 61*b* which provide pivot bearings for cradle 50, aligned apertures 77*a*, 77*b* which provide pivot bearings for trip member 76 and trip lever 105; three notches 109 that cooperate with internal housing formations to operatively position plate 60 within housing 26, 27; ear 99 which acts as a stop for trip latch 64; ear 110 which acts as a stop for cradle 50 in its tripped position; threaded aperture 111 for mechanically securing a plug-in stab (not shown) to line terminal member 38; and threaded aperture 103 for electrically connecting mounting plate 60 to strap 38 so that line terminal potential appears at ear 712 of mounting plate 60. As seen in FIG. 1, ear 712 is positioned at the rear of arc chute 113 adjacent the last deion plate (not shown) thereof to enhance rapid build-up of arc voltage in arc chute 139 upon separation of contacts 33, 34. It is noted that in FIG. 1 only internal housing grooves for positioning the deion plates of arc chute 139 are shown.

Threaded aperture 111 is aligned with clearance aperture 112 in line terminal member 38 to provide means whereby a screw (not shown) may be used to electrically and mechanically secure a line terminal stabe (not shown), positioned in housing recess 113, to line terminal member 38. For connecting the line terminal stab at another location along the length of line terminal member 38, the circuit breaker housing is provided with another recess 114 aligned with clearance aperture 115 in strap 83 and threaded aperture 116 in stationary magnetic member 86. The end of line terminal member 38 remote from magnetic member 86 is provided with elongated aperture 117 for connection of a wire grip device (not shown).

When a plurality of circuit breaker pole units 25 are mounted side by side and it is desired to mechanically coordinate tripping thereof such that automatic tripping of one unit will cause all of the other units to trip, flat transverse insulating bar 120 (FIG. 1) is provided. The latter extends through a complementary aperture in trip member 105 for each of the circuit breaker poles 25. When an abnormal current condition causes automatic tripping of a pole, cradle 50 thereof is released and moves clockwise so that section 121 thereof moves downward and engages trip lever 105 pivoting the latter counterclockwise to move trip bar 120 downward. This causes the latter to engage the trip members 76 in all of the poles to move these trip members counterclockwise thereby releasing the trip latches 64 in each of the non-faulted poles. Therefore all of the non-faulted poles open substantially at the same time the faulted pole opens. For simultaneous on-off operation of a plurality of pole units 25 arranged in a stack, a transverse rod (not shown) extends through aligned apertures 123 in each of the operating members. When this type of transverse rod is utilized at least one of the sides of housing 26, 27 is provided with an arcuate cutout 124. Similarly, circular apertures 126 are provided in one or more of the sides of housing 26, 27 to provide clearance for interpole trip bar 120.

Figures 14, 15, 16, 17, 18, 19:
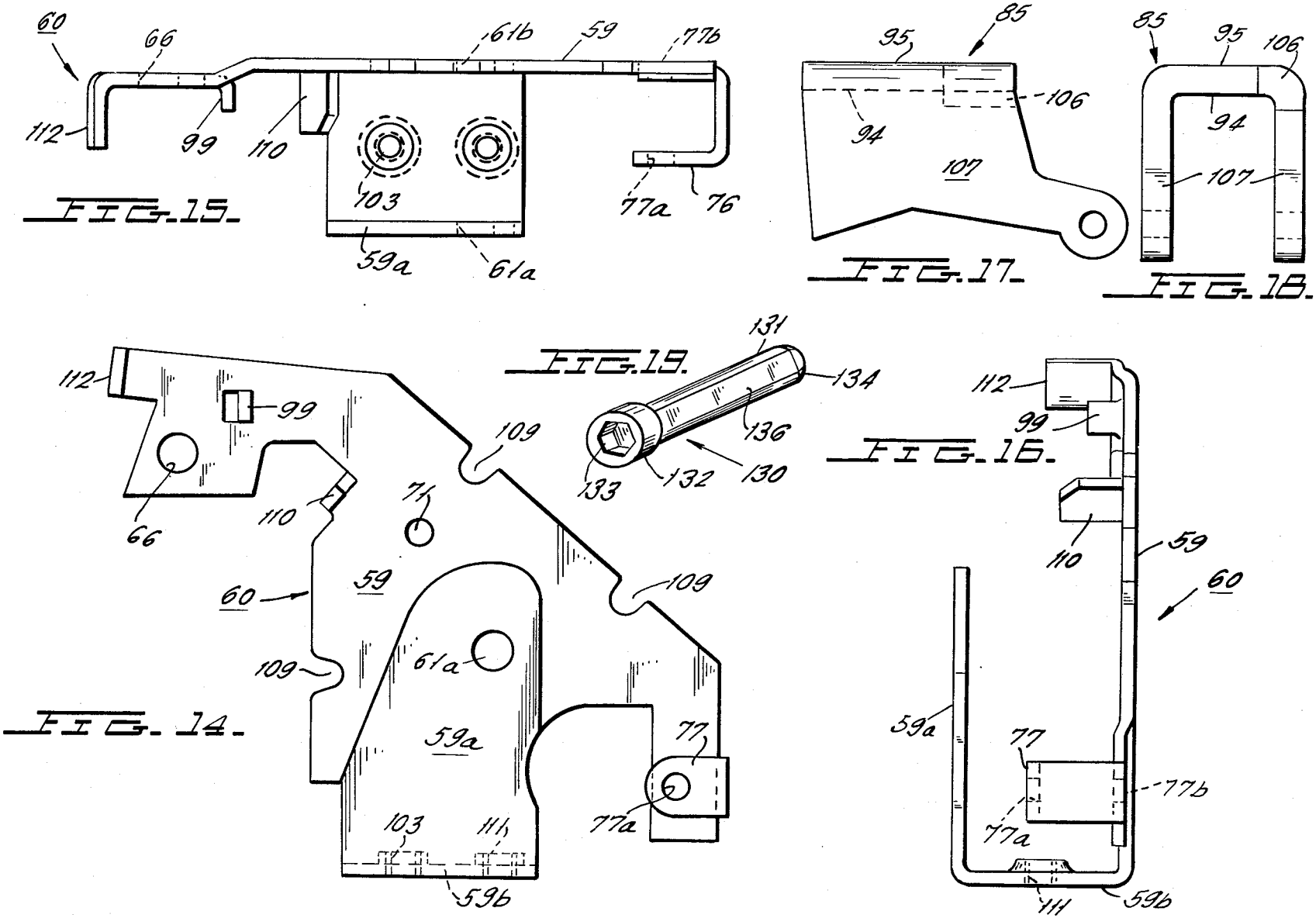
FIG. 14 is a side elevation of the mechanism mounting plate.
FIGS. 15 and 16 are a plan and side elevation, respectively, of the mounting plate.
FIGS. 17 and 18 are a side elevation and end view, respectively, of the instantaneous trip armature.
FIG. 19 is a perspective of a hex head socket rivet.

Pivot pins, 58 for cradle 50, 42 for contact arm 35 and 65 for trip latch 64, are constituted by socket rivets generally of the type illustrated in FIG. 19. The latter illustrates socket rivet 130 which includes shaft 134 and head 132 positioned at one end of shaft 134. The free end of head 132 is provided with hexagonal socket 133 centered with respect to the cylindrical axis of shaft 134. In transverse section shaft 134 consists of flat surface 136 and circular surface 131 extending for more than 180°. The aforesaid cylindrical axis coincides with the center about which circular surface 131 is generated and also coincides with the center of a bearing aperture through which shaft 134 extends. A member mounted to socket rivet 130 is secured thereto in keying relationship so that the angular position of rivet 130 indicates the position of the element secured thereto. This becomes useful when circuit breaker pole unit 25 is operated in conjunction with auxiliary features such as auxiliary switches and shunt trip devices (not shown).

Figure 6:
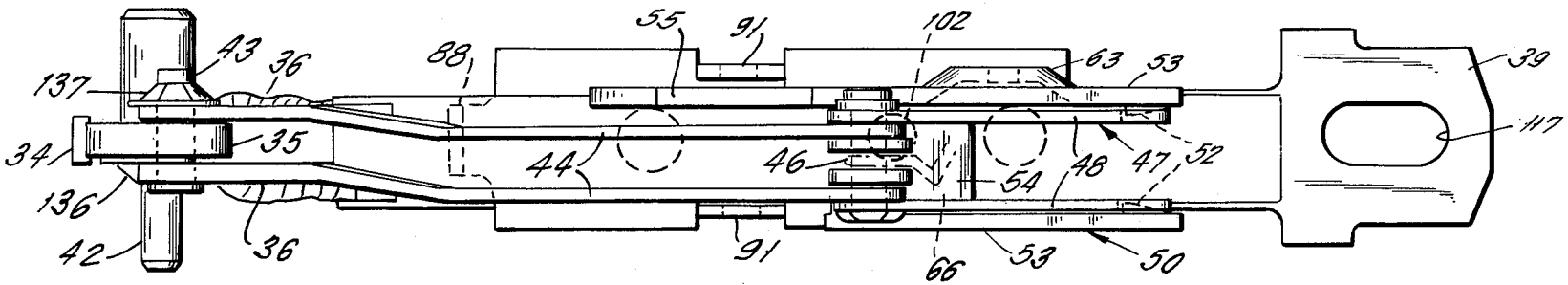
FIG. 6 is a plan view of the elements of FIG. 5.
Figure 5:
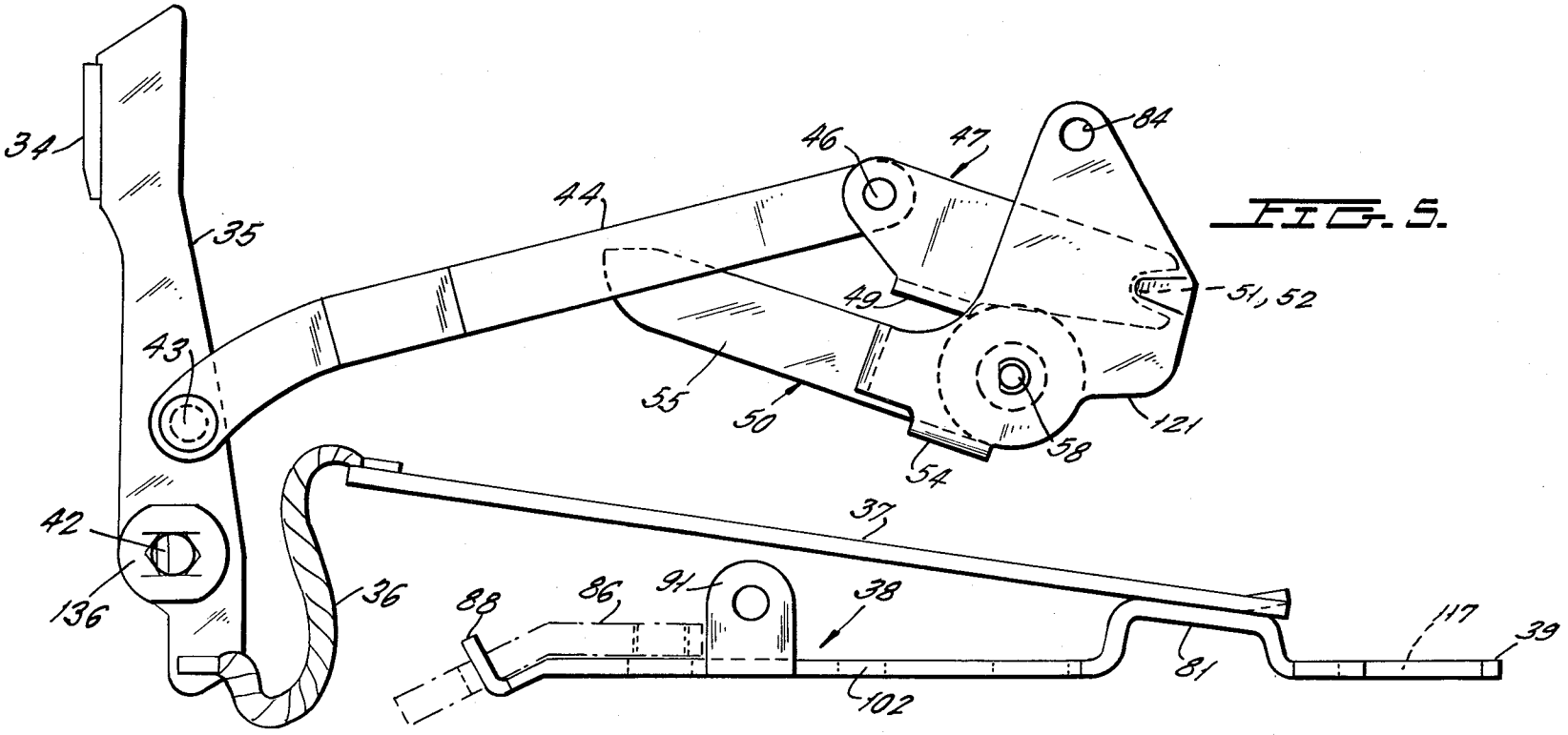
FIG. 5 is a side elevation of the contact arm subassembly attached to the toggle assembly.

It is noted that bearing pin 42 and connecting pin 43 for contact arm 35 are secured by pressing on friction nuts 136, 137, respectively, (FIG. 6). One end of pin 43 extends substantially beyond toggle link 44 so as to be engageable by internal housing formation 138 which acts as a stop to limit opening movement of contact arm 35.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. A circuit breaker pole unit includng a narrow insulating housing, cooperating movable and stationary contact means disposed within said housing, a spring powered operating mechanism for opening and closing said contact means; said mechanism including a releasable cradle, a toggle means interposed between said cradle and said movable contact means and formed by first and second links pivotally connected at a knee, manual operating means, a main operating spring connected between said knee and said manual operating means to be repositioned by the latter relative to said toggle means, a latch means for maintaining said cradle latched in an operating position wherein said operating means is operable to close said contact means; thermally and magnetically actuated automatic means for tripping said latch means responsive to predetermined abnormal current conditions thereby releasing said cradle whereby said contact means are opened; a trip member interposed between said automatic means and said latch means and operatively connected to the latter means for tripping thereof; a metal frame within said housing including individual laterally spaced bearing formations pivotally supporting said cradle, said manual operating means, said trip member and said latch means.

2. A circuit breaker pole unit as set forth in claim 1 in which the bearing formations for said latch means and said operating means each constitutes a single bearing.

3. A cicuit breaker pole unit as set forth in claim 2 in which the bearing formation for said cradle constitutes a pair of aligned bearings in spaced wall sections of said frame.

4. A circuit braker pole unit as set forth in claim 1 in which the frame also includes integrally formed stop means to engage the latch means directly and thereby establish a latching position therefor.

5. A circuit breaker pole unit as set forth in claim 4 in which the frame also includes another integrally formed stop means to engage the cradle and limit movement thereof upon release of said cradle by the latch means.

6. A circuit breaker pole unit as set forth in claim 5 in which the bearing formations for said latch means and said operating means each constitutes a single bearing, the bearing formation for said cradle constitutes a pair of aligned bearings in spaced wall sections of said frame.

7. A circuit breaker pole unit as set forth in claim 1 also including an arc chute which receives electric current arcs drawn between the contact means during circuit interruption; line and load terminal means having the respective movable and stationary contact means connected thereto; means electrically and mechanically tying said frame to said line terminal means; said frame including an ear disposed at the end of the arc chute remote from the stationary contact means.

8. A circuit breaker pole unit as set forth in claim 7 in which the frame also includes means for connecting a line connector to said line terminal means.

* * * * *